US006637042B2

(12) United States Patent
Hand

(10) Patent No.: US 6,637,042 B2
(45) Date of Patent: Oct. 28, 2003

(54) TOILET VALVE ASSEMBLY

(76) Inventor: Douglas P. Hand, 17321 SW. Canyon Dr., Lake Oswego, OR (US) 97034

( * ) Notice: Subject to any disclaimer, the term of this patent is extended or adjusted under 35 U.S.C. 154(b) by 0 days.

(21) Appl. No.: 10/280,979

(22) Filed: Oct. 24, 2002

(65) Prior Publication Data

US 2003/0028958 A1 Feb. 13, 2003

Related U.S. Application Data

(62) Division of application No. 09/765,690, filed on Jan. 19, 2001, now Pat. No. 6,484,327.

(51) Int. Cl.[7] ..... E03D 3/12
(52) U.S. Cl. ..... 4/327
(58) Field of Search ..... 4/324–327

(56) References Cited

U.S. PATENT DOCUMENTS

| | | | | |
|---|---|---|---|---|
| 3,172,129 | A | | 3/1965 | Fulton et al. |
| 3,186,007 | A | | 6/1965 | Falotico |
| 3,267,491 | A | | 8/1966 | Snyder et al. |
| 3,795,016 | A | | 3/1974 | Eastman |
| 3,890,652 | A | | 6/1975 | Fulton |
| 3,916,455 | A | | 11/1975 | Longdin |
| 3,958,281 | A | | 5/1976 | Remmel |
| 4,042,982 | A | | 8/1977 | Contreras |
| 4,096,591 | A | | 6/1978 | Awis |
| 4,115,882 | A | | 9/1978 | Paulus |
| 4,172,299 | A | | 10/1979 | Del Pozo |
| 4,353,138 | A | | 10/1982 | Bell |
| 4,604,763 | A | | 8/1986 | Sprang |
| 5,005,225 | A | | 4/1991 | Pasquin |
| 5,754,986 | A | | 5/1998 | Chien |
| 5,813,059 | A | | 9/1998 | Wang |
| 5,881,399 | A | | 3/1999 | Kartoleksono et al. |
| 6,041,452 | A | | 3/2000 | Hsiao et al. |
| 6,094,753 | A | * | 8/2000 | Korte ..... 4/325 |
| 6,178,567 | B1 | | 1/2001 | Bliss |

FOREIGN PATENT DOCUMENTS

| | | | |
|---|---|---|---|
| DE | 2829194 | A1 | 1/1980 |
| DE | 3319649 | A1 | 10/1983 |
| DE | 3221747 | A1 | 12/1983 |
| EP | 0448092 | * | 9/1991 |

* cited by examiner

*Primary Examiner*—Charles E. Phillips
(74) *Attorney, Agent, or Firm*—Kolisch Hartwell, P.C.

(57) ABSTRACT

A dual flush-volume outflow valve assembly for a toilet tank is provided. The outflow valve assembly comprises a base having an opening configured to pass water out of the toilet tank, a lower outflow tube section extending upwardly from the base, and an upper outflow tube section adjustably coupled to and extending upwardly from the lower outflow tube section. The lower outflow tube has a hollow interior and includes a high-volume flush valve positioned to pass a first, larger volume of water from the toilet tank to the toilet bowl when opened. The upper outflow tube section has a hollow interior and includes a low-volume flush valve positioned to pass a second, smaller volume of water from the toilet tank to the toilet bowl when opened. In some embodiments, the hollow interiors of the upper outflow tube section and the lower outflow tube section are positioned over and in line with the opening.

13 Claims, 8 Drawing Sheets

TOILET VALVE ASSEMBLY

CROSS-REFERENCE TO RELATED APPLICATION

This application is a divisional application of U.S. patent application Ser. No. 09/765,690, filed Jan. 19, 2001, which is hereby incorporated by reference.

TECHNICAL FIELD

The present invention relates to a dual flush-volume valve assembly for a toilet tank. More particularly, the invention provides a dual flush-volume valve assembly for a toilet tank that offers improved control over the volume of the low-volume flush.

BACKGROUND OF THE INVENTION

In the past, most toilets manufactured in the U.S. discharged approximately 3–5 gallons of water per flush. More recently, however, concerns with water conservation, combined with federal law requiring new toilets to have a maximum discharge volume of 1.6 gallons per flush, have led to the development of new water-conserving toilet systems and various devices for reducing the water consumption of older toilets.

One example of a device used to increase the efficiency of older toilets is a dual flush-volume toilet tank outflow valve assembly. Dual flush valve assemblies utilize separate flush valves that discharge different amounts of water for flushing solid and liquid waste. In one type of dual flush valve assembly, a high-volume flush valve is positioned near the bottom of the toilet tank to pass a higher volume of water for flushing solid waste, and a low-volume flush valve is positioned higher in the toilet tank for passing a lower volume of water for flushing liquid waste. Thus, a user may select a high-volume flush when clogging presents a problem, and otherwise use a low-volume flush.

While known dual flush-volume valve assemblies do offer improved water conservation relative to older, high-volume toilet systems, they also have several shortcomings. For example, known dual flush-volume valve assemblies permit little, if any, adjustment of the relative volumes of the low-volume flush and the high-volume flush. This can pose a problem in retrofitting older toilet tanks, as the volume of water passed from the toilet tank during a low-volume flush may be dependent upon the shape of the toilet tank. As an example, when using a dual valve assembly of a given height, more water may be discharged by the low-volume valve from a taller tank than from a shorter tank, as the level of water in the shorter tank may be closer to the low-volume valve than in the taller tank. This may cause problems with flushing, as an inadequate amount of water to flush waste from the toilet bowl may be discharged if the maximum water level in the toilet tank is too close to the low-volume valve.

Another problem with known dual flush valve assemblies is that the pipe that supports the low-volume flush valve is generally horizontally offset from the outflow hole in the bottom of the toilet tank. Thus, water that is discharged through the low volume valve must flow at least somewhat horizontally to reach toilet tank outflow hole. This may decrease the velocity of the flush, and thus may also decrease the effectiveness of the flush.

SUMMARY OF THE INVENTION

The present invention provides a dual flush-volume outflow valve assembly for a toilet tank. The outflow valve assembly comprises a base having an opening configured to pass water out of the toilet tank, a lower outflow tube section extending upwardly from the base, and an upper outflow tube section slidingly coupled to and extending upwardly from the lower outflow tube section. The lower outflow tube has a hollow interior and includes a high-volume flush valve positioned to pass a first, larger volume of water from the toilet tank to the toilet bowl when opened. The upper outflow tube section has a hollow interior and includes a low-volume flush valve positioned to pass a second, smaller volume of water from the toilet tank to the toilet bowl when opened. In some embodiments, the hollow interiors of the upper outflow tube section and the lower outflow tube section are positioned over and in line with the opening.

DETAILED DESCRIPTION OF THE PREFERRED EMBODIMENTS

Figure 1:
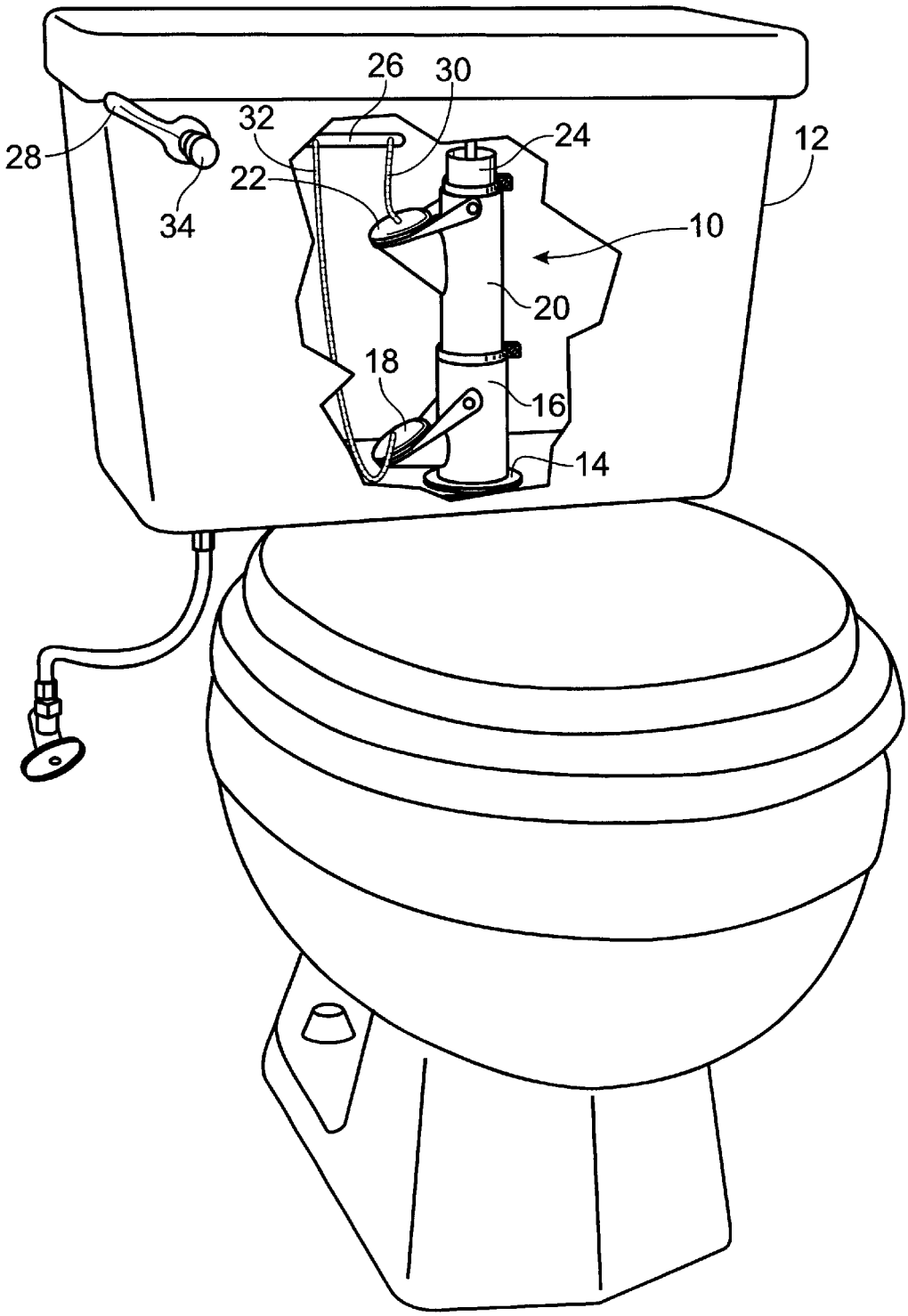
FIG. 1 is an isometric view of a first embodiment of an outflow valve assembly according to the present invention, positioned in a toilet tank.

The present invention provides a dual flush-volume toilet tank outflow valve assembly that offers improved adjustability and flush performance compared to known dual valve assemblies. A first embodiment of a valve assembly according to the present invention is shown generally at 10 in FIG. 1, positioned in a toilet tank 12. Valve assembly 10 includes a base 14 with which it may be mounted to the inside of toilet tank 12. A lower outflow tube section 16 extends upwardly from base 14, and a high-volume flush valve 18 is positioned on the lower outflow tube section adjacent the bottom of the interior of toilet tank 12. High-volume flush valve 18 is configured to empty essentially all water from toilet tank 12 when opened to provide a higher volume flush for flushing solid wastes. An upper outflow tube section 20 is slidingly coupled to lower outflow tube section 16, and a low-volume flush valve 22 is positioned on the upper outflow tube section. Low-volume flush valve 22 is configured to empty toilet tank 12 only partially, thus providing a water-saving, smaller volume flush.

The slidable connection of lower outflow tube section 16 to upper outflow tube section 20 allows the height of low-volume flush valve 22 to be adjusted relative to the height of high-volume flush valve 18. This allows the volume of water discharged by low-volume flush valve 22 to be adjusted for toilet tanks of different sizes, permitting the volume of water discharged by the low-volume flush valve to be quickly and easily adjusted over a wide range of volumes. This wide range of adjustability allows valve system 10 to be used in essentially any new or existing gravity flush toilet system. Valve assembly 10 also includes an overflow tube section 24, which also may be adjustable in height.

FIG. 1 also shows an example of a suitable setup for the operation of valve system 10 in a toilet. High-volume flush valve 18 and low-volume flush valve 22 are both attached to a single flush wand 26, which is operated by a handle 28. Low-volume flush valve 22 is connected to flush wand 26 with a first, shorter length of chain 30, and high-volume flush valve 18 is connected to the flush wand with a second, longer length of chain 32. Second length of chain 32 is configured to have more slack than first length of chain 30. This allows low-volume flush valve 22 to be opened by pushing handle 28 only partially down when a low volume flush is desired, and both the low-volume flush valve and high-volume flush valve 18 to be opened by pushing handle 28 farther down when a higher volume flush is desired. In the depicted embodiment, handle 28 employs a special mechanism, described in more detail below, that prevents the handle from being pushed far enough to open high-volume flush valve 18 unless a handle release button 34 is held down.

Figure 3:
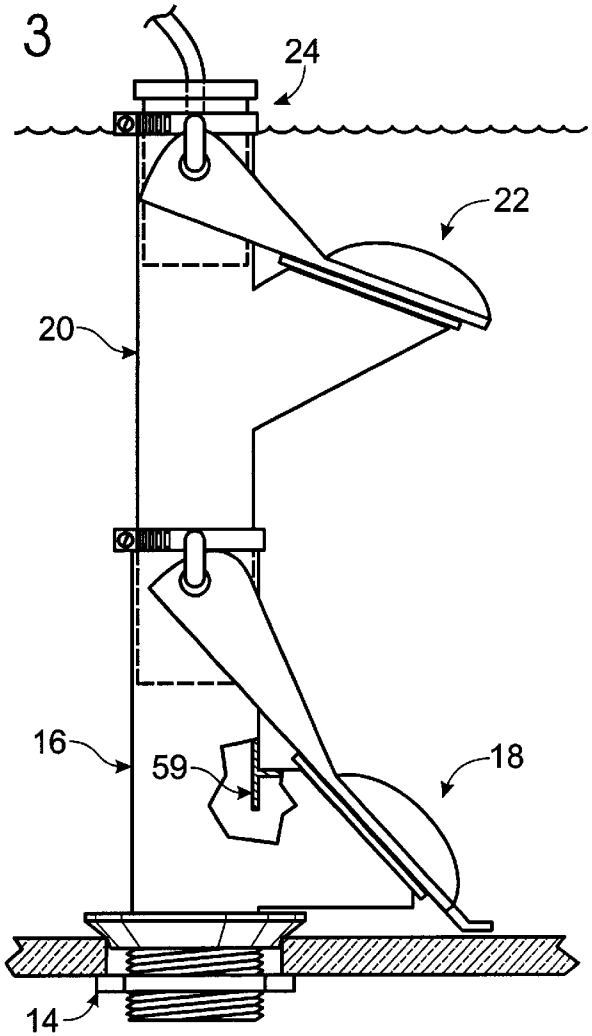
FIG. 3 is a side elevational view of the embodiment of FIG. 1, with the low-volume flush valve in a second, higher position relative to the high-volume flush valve.
Figure 2:
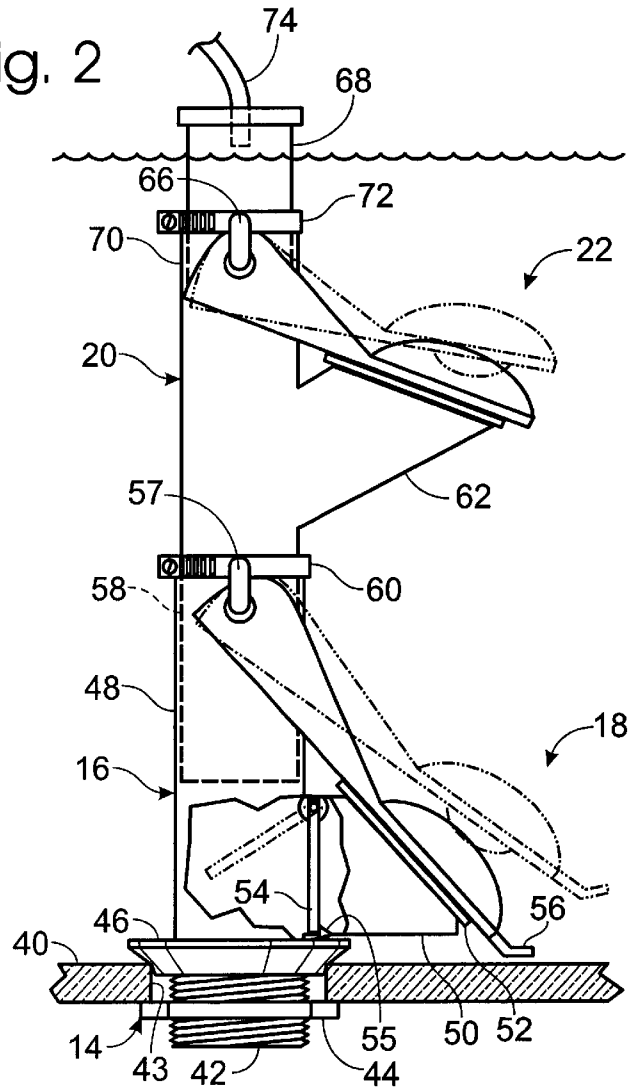
FIG. 2 is a side elevational view of the embodiment of FIG. 1, with the low-volume flush valve in a first, lower position relative to the high-volume flush valve.

FIGS. 2 and 3 show valve assembly 10 in more detail. As mentioned above, valve assembly 10 includes a base 14 configured to couple valve assembly 10 to the bottom 40 of toilet tank 12 and to pass water out of the toilet tank. In the depicted embodiment, base 14 takes the form of a spud, but it will be appreciated that base 14 may have any other suitable configuration. Base 14 includes a threaded portion 42 that fits through toilet tank outflow hole 43, and is secured to bottom 40 of toilet tank 12 with a nut 44. The connection may be scaled with a gasket 46.

Lower outflow tube section 16 is connected to base 14, and includes a hollow upright portion 48 to which upper outflow tube section 20 is coupled. Upright portion 48 supports upper outflow tube section 20 above base 14, and also channels water discharged through low-volume flush valve 22 through toilet tank outflow hole 43. Upright portion may have any suitable configuration. For example, upright portion 48 may have a bend that offsets upper outflow tube section 20 relative to base 14. In the depicted embodiment, however, upright portion 48 extends directly above base 14, such that the hollow interior of upright portion 48 is positioned directly above and in line with the opening in base 14. In this configuration, water discharged through low-volume flush valve 22 can pass straight down through lower outflow tube section 16 without any horizontal deflection, and thus may increase the velocity of the flush.

Lower outflow tube section 16 also includes a lower side tube 50 extending away from upright portion 48, which connects high-volume flush valve 18 to upright portion 48. Lower side tube 50 may have any suitable configuration, and may be positioned at any desired location on lower outflow tube section 16. In the depicted embodiment, lower side tube 50 is oriented generally parallel to toilet tank bottom 40, and is positioned directly adjacent the toilet tank bottom. This places the lower edge of the lip 52 of high-volume valve 18 very close to the bottom of toilet tank, and thus permits essentially all of the water to drain from the tank when the high-volume flush valve is opened. While high-volume flush valve is connected to upright portion 48 with lower side tube 50 in the depicted embodiment, it will be appreciated that high-volume flush valve may also be attached directly to the side of upright portion 48, without the use of lower side tube 50.

When water is discharged from toilet tank 12 via low-volume flush valve 22, it is possible that some water may flow into lower side tube 50. To direct water discharged through low-volume flush valve 22 away from the opening of lower side tube 50, valve system 10 may include a water flow diverter disposed in the interior of lower outflow tube section 16. This water flow diverter may have any suitable design. In the depicted embodiment, the water flow diverter takes the form of a plate 54 attached with a hinge to the joint between lower side tube 50 and upright portion 48, within the hollow interior of lower outflow tube section 16. In the absence of water flowing through lower side tube 50, plate 54 hangs downward across the opening to lower side tube 50, as shown in solid lines in FIG. 2. When water is discharged through low-volume flush valve 22, plate 54 blocks the opening of lower side tube 50, and thus prevents water from flowing into the lower side tube. A stop is positioned in lower side tube 50 to prevent plate 54 from swinging into lower side tube 50 when water is flushed through low-volume flush valve 22.

In contrast, when water is flushed through high-volume flush valve 18, plate 54 is pushed away from the high-volume flush valve by the water, as shown in dashed lines in FIG. 2. This allows the water to flow out of side tube 50 and out of toilet tank 12. Alternatively, the water flow diverter may take the form of a stationary barrier 59 that extends partially over the opening of lower side tube 50, as shown in FIG. 3.

High-volume flush valve 18 is configured to cover the end of lower side tube 50 to control the discharge of water through the lower side tube. High-volume flush valve 18 is thus positioned at the free end of lower side tube 50, and is pivotally anchored to a pair of arms 57 located on upright portion 48. In the depicted embodiment, high-volume flush valve 18 is a flapper valve, but may also be any other suitable type of valve. High-volume flush valve 18 may include a seal extension 56 that extends past lower lip 52 of the high-volume flush valve when the high-volume flush valve is in the closed position, shown in solid lines in FIG. 2. Seal extension 56 is configured to help prevent the opening of high-volume flush valve 18 by water flushed through low-volume flush valve 22 by increasing the total water pressure against the high-volume flush valve when the high-volume flush valve is closed.

As mentioned above, upper outflow tube section 20 is slidably coupled to upright portion 48 of lower outflow tube section 16. This allows the height of low-volume flush valve 22 to be quickly and easily adjusted relative to the height of high-volume flush valve 18. FIG. 2 shows low-volume flush valve 22 in a first, lower position relative to high-volume flush valve 18, and FIG. 3 shows the low-volume flush valve in a second, higher position. Note that low-volume flush valve 22 is farther from the surface of the water in the toilet tank in FIG. 2, causing more water to flow out of the high-volume valve when it is opened. Another advantage of the use of a slidable joint is that the joint allows the height of low-volume flush valve to be chosen from a continuous range of possible heights.

The construction of the slidable joint between lower outflow tube section 16 and upper outflow tube section 20 is shown in FIGS. 2 and 3. Upper outflow tube section 16 includes an elongate neck 58 configured to fit within upright portion 48 of lower outflow tube section 20 such that it may be slid into or out of the lower outflow tube section. Elongate neck 58 may have any desired length. Generally, a longer elongate neck 58 provides for a greater range of height adjustability for low-volume flush valve 22. However, if elongate neck 58 has too great a length, it may interfere with the flow of water through lower side tube 50. In the depicted embodiment, elongate neck 58 is long enough to just reach the top of lower side tube 50 when it is fully extended into lower outflow tube section 16. The position of upper outflow tube section 20 relative to lower outflow tube section 16 may be fixed with a locking collar 60. In the depicted embodiment, locking collar 60 is a worm-drive clamp, but upper outflow tube section 20 may be fixed to lower outflow tube section 16 with any other desired locking device. Furthermore, other suitable methods for fixing upper outflow tube section 16 in position relative to lower outflow tube section 20, such as a friction mechanism using an O-ring seal, may also be used.

In addition to elongate neck 58, upper outflow tube section also includes an upper side tube 62 and the aforementioned overflow tube 24. Upper side tube 62 connects low-volume flush valve 22 to upright portion 48, and provides a path for water to flow from low-volume flush valve 22 into elongate neck 58. Upper side tube 62 may have any suitable configuration, and may be located in any desired position on upper outflow tube section 16. In the depicted embodiment, lower side tube 62 extends diagonally upward from elongate neck 58. Low-volume flush valve 22 is positioned at the upper end of upper side tube 62, and is pivotally attached to a pair of arms 66 located on overflow tube 24. In the depicted embodiment, low-volume flush valve 22 is a flapper valve, but it may also be any other suitable type of valve.

When upper outflow tube section 20 is raised or lowered relative to lower outflow tube section 16, the height of overflow tube 24 will also be changed. To compensate for this, or to permit the maximum water level of the toilet to be adjusted, overflow tube 24 may have an adjustable height. In the depicted embodiment, overflow tube 24 has a slidable adjustment mechanism, although other mechanisms may be used. A sliding adjustment mechanism is preferable, as it allows the height of overflow tube 24 to be quickly adjusted to any desired height within a range of possible heights. In the depicted embodiment, overflow tube 24 is formed from an upper overflow tube section 68 that fits within a lower overflow tube section 70. Lower overflow tube section 70 may include a locking collar 72 for fixing the position of upper overflow tube section 68 relative to lower overflow tube section 70. A toilet bowl refill tube 74 may be threaded into overflow tube 24 for refilling the toilet bowl after a flush.

Figure 4:
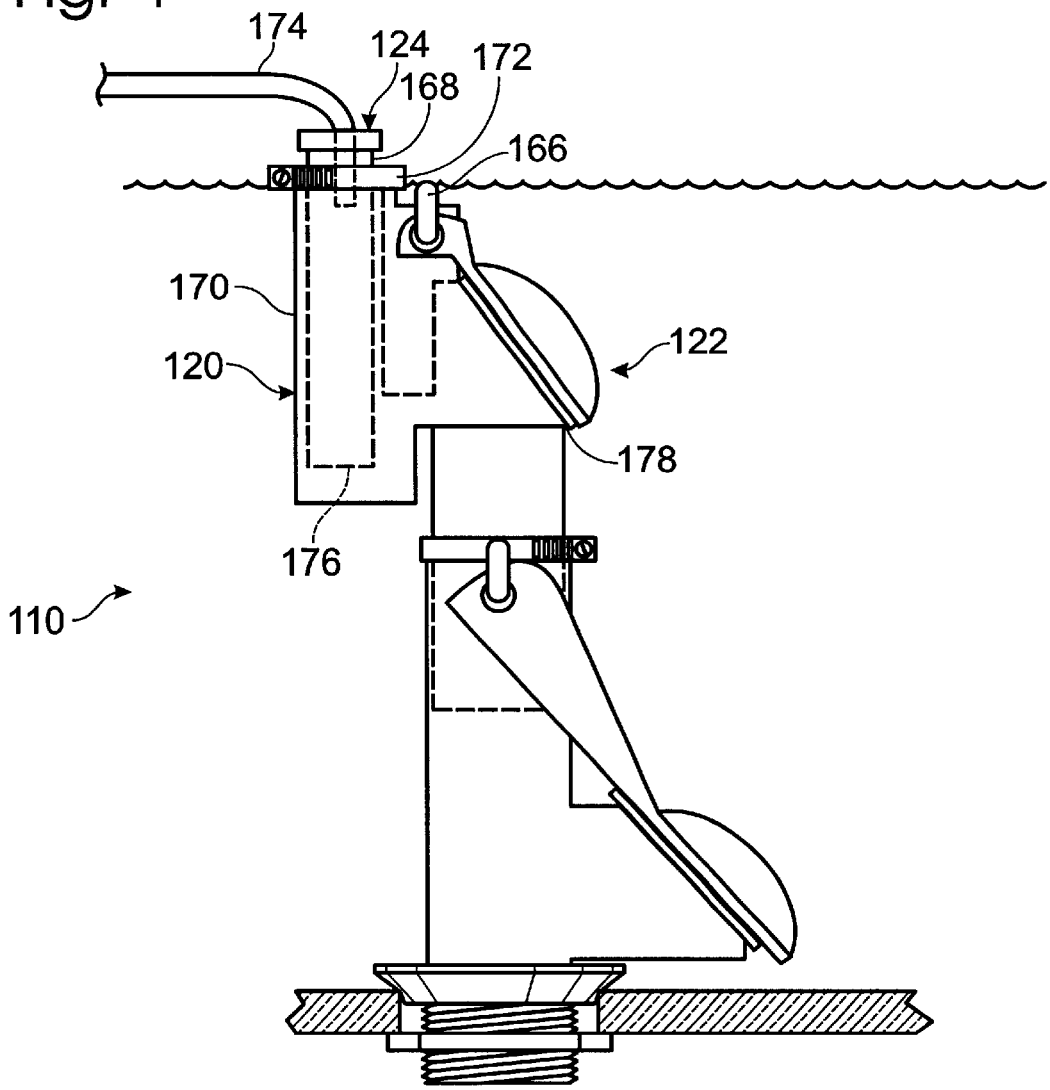
FIG. 4 is a side elevational view of a second embodiment of an outflow valve assembly according to the present invention.

A second embodiment of a valve assembly according to the present invention is shown generally at 110 in FIG. 4. Valve assembly 110 is similar in appearance and operation to the first embodiment, but utilizes a different upper outflow tube section, indicated at 120. Upper outflow tube section 120 has an offset overflow tube 124, which allows low-volume flush valve 122 to be positioned directly over the base. In this configuration, water flushed through low-volume flush valve 122 passes directly downward from the low-volume flush valve out of the toilet tank, without any horizontal deflection. This may increase the water velocity of the low-volume flush, and thus may lead to a more efficient flush.

Offset overflow tube 124 is formed from an upper overflow tube section 168 slidingly coupled to a lower overflow tube section 170. This allows the height of overflow tube 124 to be adjusted, and thus permits the overflow tube height to be changed to compensate for changes in the height of the low-volume flush valve, or to change the maximum water level in the toilet tank. A locking collar 172 may be provided to allow upper overflow tube section 168 to be fixed in position relative to lower overflow tube section 170. A pair of arms 166 may be provided on overflow tube 124 as a location for the attachment of low-volume flush valve 122. A refill tube 174 for refilling the toilet bowl after a flush may be attached to upper overflow tube section 168.

Positioning overflow tube 124 in an offset position also allows the overflow tube to have a greater range of adjustability than if it were positioned directly over upper outflow tube section 120. In the embodiment shown in FIG. 4, the bottom edge 176 of overflow tube 124 extends below the upper edge 178 of upper outflow tube section 120, permitting the length of upper overflow tube section 168 to be correspondingly increased.

Figure 5:
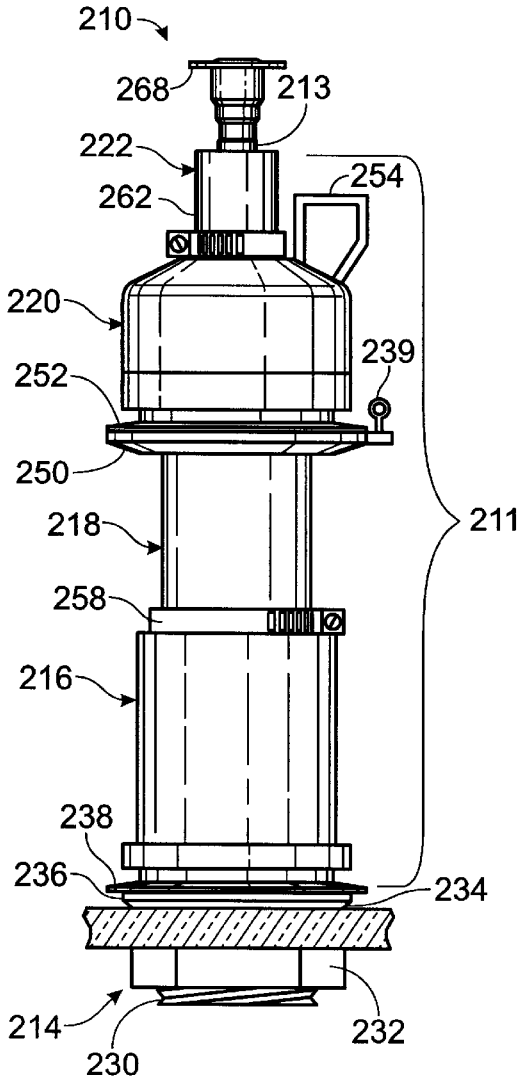
FIG. 5 is a side elevational view of a third embodiment of an outflow valve assembly according to the present invention.
Figure 6:
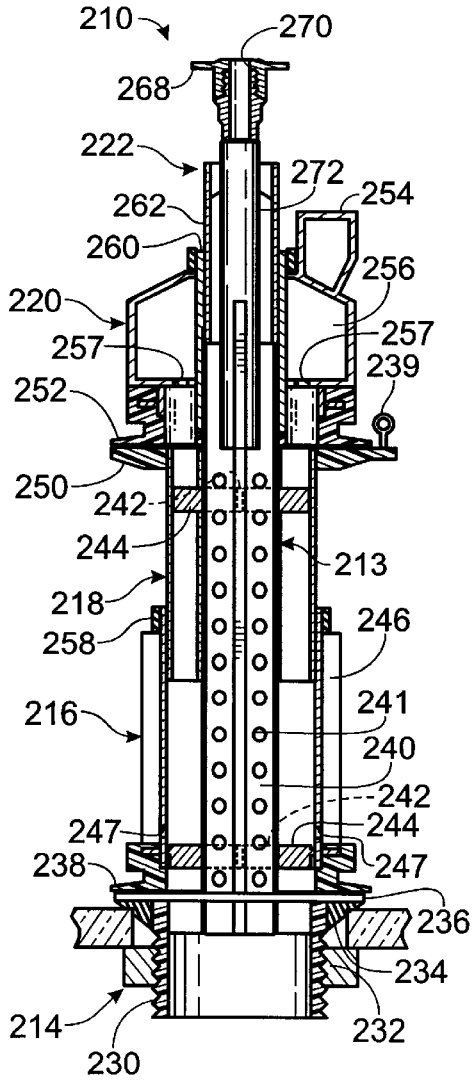
FIG. 6 is a partially sectioned view of the embodiment of FIG. 5, with both valves in closed positions.

FIGS. 5–8 show generally at 210 a third embodiment of a valve assembly according to present invention. Rather than a flapper-style valve system, valve assembly 210 provides a column-type valve assembly, in which an upright column structure 211 may be lifted directly upward along a guide 213 to open a space between the column structure and the valve base, thus allowing water to flow out of the toilet tank. As shown in FIGS. 5–6, valve assembly 210 includes a base 214 and the aforementioned column structure 211, which is formed of a lower outflow tube section 216, an upper outflow tube section 218, a cap piece 220 and an overflow tube 222. Upper outflow tube section 218 is adjustably coupled to lower outflow tube section 216 to allow the volume of the low-volume flush to be adjusted.

Base 214 is configured to couple valve assembly 210 to the bottom 40 of toilet tank 12 and to pass water out of the toilet tank. In the depicted embodiment, base 214 takes the form of a spud, but it will be appreciated that base 214 may have any other suitable configuration. Base 214 includes a threaded portion 230 that fits through toilet tank outflow hole 43, and is secured to bottom 40 of toilet tank 12 with a nut 232. The connection may be sealed with a gasket 234.

Base 214 also includes an upper surface 236 that forms part of the high-volume flush valve. In the depicted embodiment, upper surface 236 is a flat surface configured to form a watertight seal with a gasket 238 situated on lower outflow tube section 216. The high-volume flush valve is opened by separating gasket 238 from upper surface 236 of base 214, permitting water to drain from toilet tank 12 through the base. The gasket and upper surface are separated by pulling upwardly on a ring 239 attached to upper outflow tube section 218, thus lifting column structure 211 along guide 213.

As described above, guide 213 extends upwardly from base 214 and guides the movement of column structure 211 when the lower outflow tube section is raised or lowered. Guide 213 may have any suitable configuration. In the depicted embodiment, guide 213 is formed from four upwardly-extending ribs 240 arranged in a cross-like configuration, but may have any other suitable configuration. Guide 213 may also include a series of holes or raised portions 241 to reduce the noise of water flowing down guide 213 as the toilet bowl is refilled after flushing.

Lower outflow tube section 216 includes a ring 242 that surrounds guide 213 to hold column structure 211 centered on guide 213. Ring 242 is attached to the inside of lower outflow tube section 216 with one or more plastic spacers 244, and travels along guide 213 as lower outflow tube section 216 is moved up or down to open or close the high-volume flush valve, respectively. Valve assembly 210 may have as many rings 242 as desired for guiding lower outflow tube section 216 (and upper outflow tube section 218) along guide 213. Two rings 242 are shown in the depicted embodiment.

Lower outflow tube section 216 also includes a float 246. Float 246 is formed from a hollowed, air-containing chamber surrounding lower outflow tube section 216. When the high-volume valve is opened, float 246 holds the high-volume valve open until the water drains to the level of upper surface 236 of base 214. One or more small holes 247 may be formed in the bottom of float 246 to allow for the equalization of pressure between the float and the outside atmosphere. Holes 247 open into the hollow interior of lower outflow tube section 216 so that any water that may get inside of float 246 will drain out of the toilet tank.

Similar in operation to the high-volume flush valve, the low-volume flush valve of valve assembly 210 is formed from the junction of upper outflow tube section 218 and cap section 220. The seal of the low-volume flush valve is formed between the top surface 250 of upper outflow tube section 218 and a gasket 252 attached to the bottom of cap section 220. Separating gasket 252 from top surface 250 lifts cap section 220 along guide 213, and thus opens the high volume valve. A chain attachment ring 254 is disposed on cap section 220 to allow the attachment of a chain or wand so that cap section 220 may be lifted with wand 26, or another suitable mechanism. A float 256 formed in cap section 220 holds the low-volume flush valve open until water drains to the level of top surface 250. One or more small holes 257 may be provided to allow the pressure within float 256 to equalize with the outside atmosphere.

To allow the volume of the low-volume flush to be adjusted, upper outflow tube section 218 is adjustably coupled to the upper portion of lower outflow tube section 216. Lower outflow tube section 216 and upper outflow tube section 218 may be adjustably coupled in any desired manner. For example, the upper portion of lower outflow tube section 216 and the lower portion of upper outflow tube section 218 may have complementary threads so that the height of the upper outflow tube section may be adjusted by turning the upper outflow tube section. In the depicted embodiment, however, upper outflow tube section 218 is slidingly coupled to lower outflow tube section. A suitable locking device, such as a worm drive clamp 258, may be used to fix upper outflow tube section 218 in position relative to lower outflow tube section 216.

Overflow tube 222 is attached to the top portion of cap section 220, and may have any suitable design for allowing excess water to drain from toilet tank 12. For example, overflow tube 222 may have a fixed height relative to cap section 220. In the depicted embodiment, however, overflow tube 222 has an adjustable height. This allows the height of the overflow tube to be adjusted to compensate for adjustments in the height of the low-volume flush valve, and also to allow the maximum water level in the toilet tank to be adjusted.

Overflow tube 222 is formed from a lower overflow tube section 260 slidingly coupled to an upper overflow tube section 262. Lower overflow tube section 260 of the depicted embodiment is formed from a molded tubular inner section of cap section 220, but may also be formed from a separate tubular piece. Lower overflow tube section 260 preferably has a diameter that closely fits guide 213 so that guide 213 holds cap section 220 centered over upper outflow tube section 218 and lower outflow tube section 216. Upper overflow tube section 262 fits snugly within, or outside of, the inner diameter of lower overflow tube section 260 so that it may be slid upward or downward relative to the lower overflow tube section to adjust the height of overflow tube 222. A locking device, such as a worm drive clamp 266, may be used to fix the height of upper overflow tube section 262 relative to lower overflow tube section 260.

To prevent cap piece 220 from being moved above the top of guide 213, guide 213 includes a stop 268 with a greater diameter than the diameter of upper overflow tube section 262. Stop 268 may be attached to guide 213 in any suitable manner. In the depicted embodiment, cap 268 is connected to guide 213 with a threaded connection.

Stop 268 may include a refill hole 270 configured to accept a toilet bowl refill line. In the depicted embodiment, guide 213 also includes a refill tube 272 extending downwardly from refill hole 270 past the level of top surface 250 of upper outflow tube section 218. This helps to prevent water flowing through refill hole 270 from compromising the integrity of the seal of the low-volume flush valve.

Figure 7:
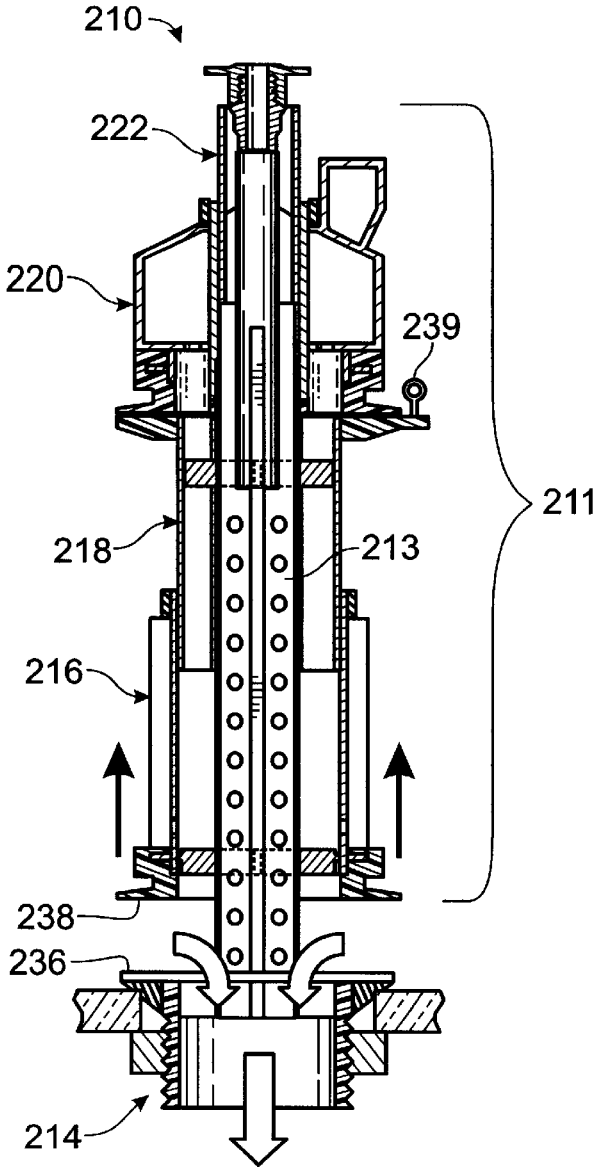
FIG. 7 is a partially sectioned view of the embodiment of FIG. 5, with the high-volume flush valve in an open position.
Figure 8:
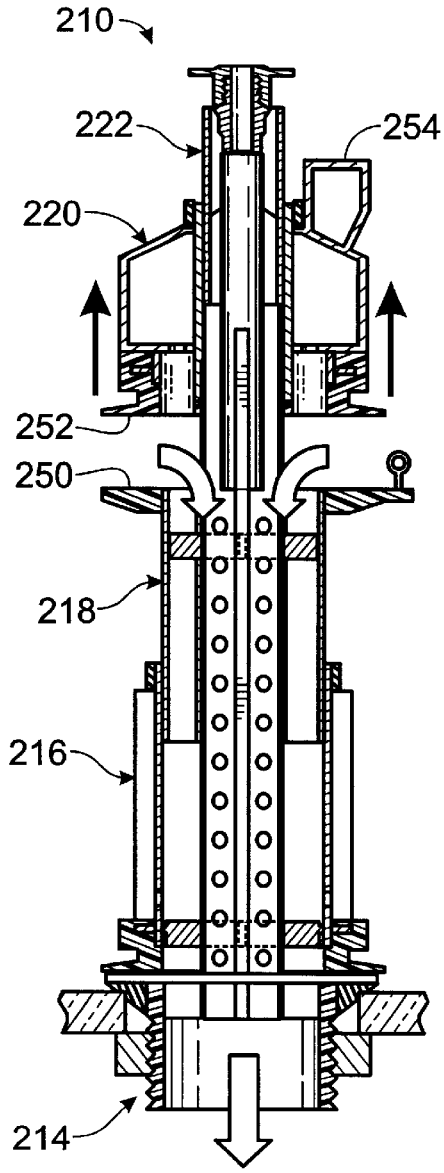
FIG. 8 is a partially sectioned view of the embodiment of FIG. 5, with the low-volume flush valve in an open position.

FIGS. 7 and 8 illustrate operation of the valve assembly. Referring to FIG. 7, when the entire column structure 211 is lifted from base 214, water can flow through the high-volume flush valve formed by the gap between the lower outflow tube section and the base, thus emptying essentially the whole toilet tank. Next, referring to FIG. 8, when cap section 220 is lifted from upper outflow tube section 218, water can flow through the low-volume flush valve formed by the gap between the upper outflow tube section and the cap section, thus only partially emptying the toilet tank.

Many types of handle systems may be used to operate a toilet valve assembly according to the present invention. For example, a double handle system may be used, in which each outflow valve is operated by a separate handle. FIGS. 9–13 illustrate another suitable handle system 310, which utilizes a single handle 28 that operates both flush valves. Ordinarily, handle 28 opens only the low-volume flush valve. However, handle system 310 includes a button 34 that may be depressed to allow operation of the high-volume flush valve with handle 28.

Figure 9:
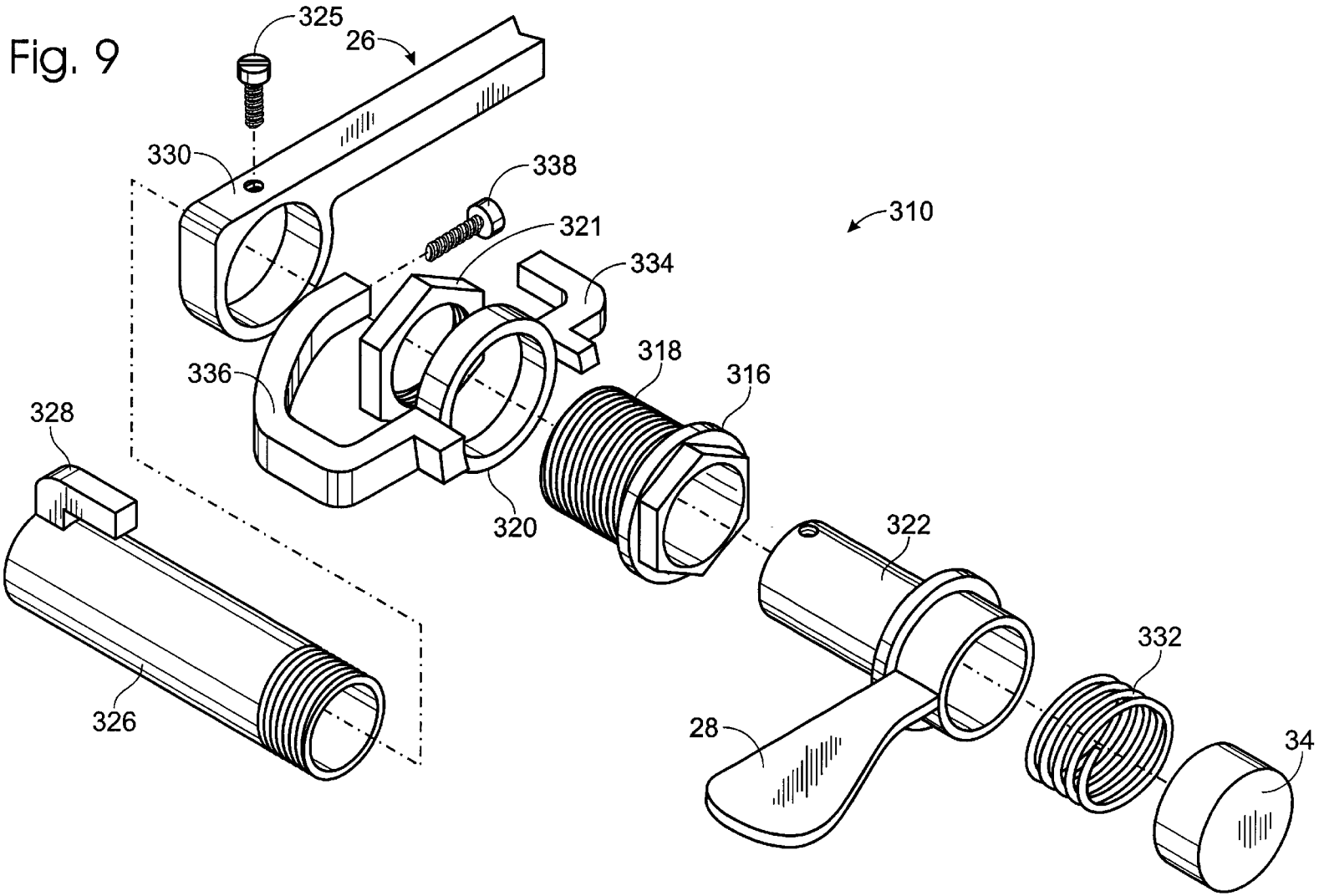
FIG. 9 is an exploded isometric view of a toilet handle assembly suitable for use with an outflow valve assembly of the present invention.
Figure 10:
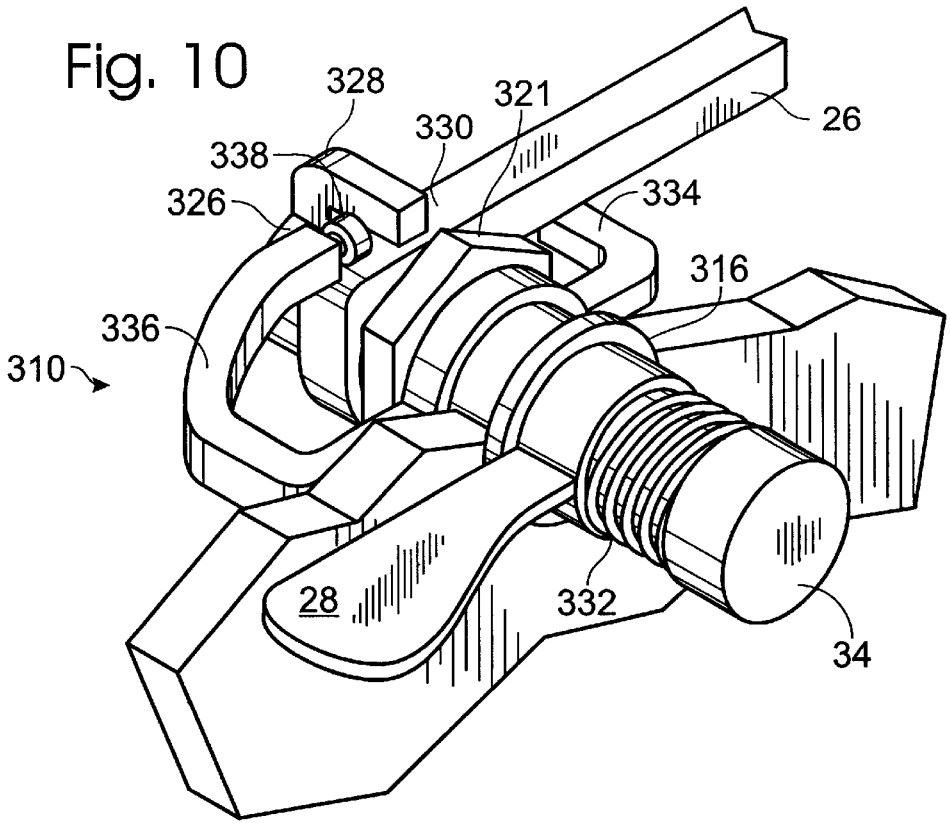
FIG. 10 is an isometric view of the toilet handle assembly of FIG. 9.
Figure 11:
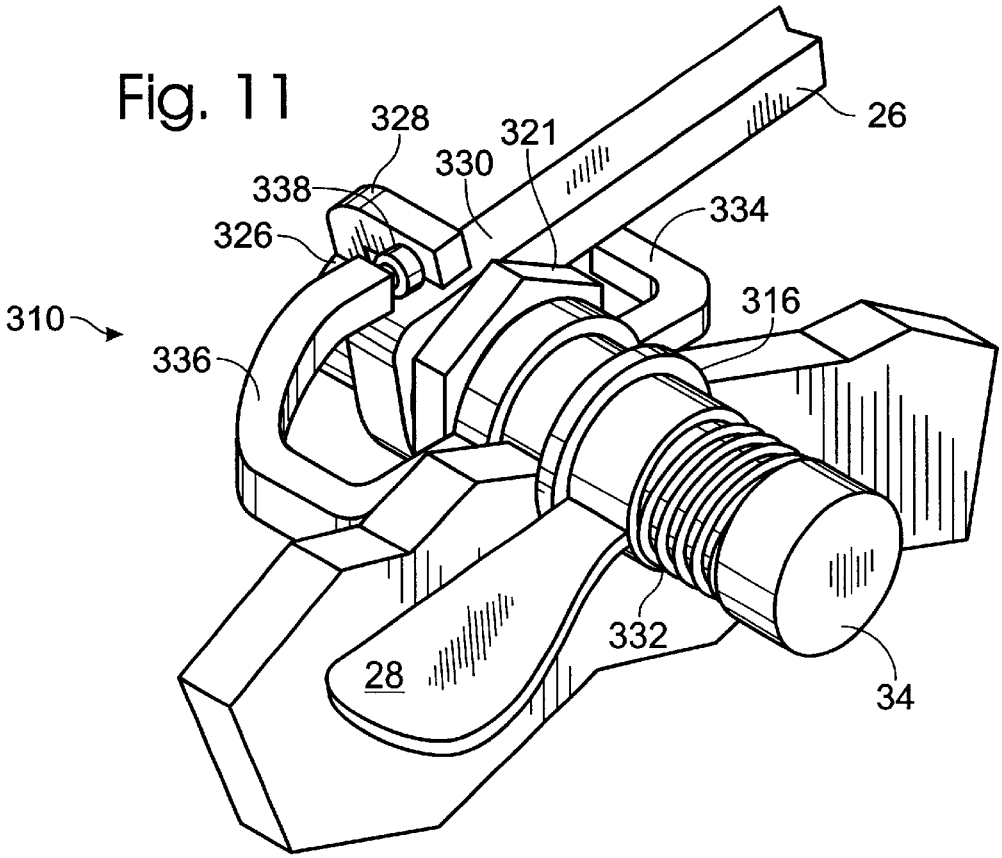
FIG. 11 is an isometric view of the toilet handle assembly of FIG. 9, illustrating the operation of the handle for a low-volume flush.

The construction of handle system 310 is shown in detail in FIG. 9. Handle 28 attaches to the toilet tank with a cylindrical bushing 316 configured to extend through a hole in the toilet tank wall. One end 318 of bushing 316 is threaded so that bushing 316 can be attached to the toilet tank with a nut 321. Nut 321 also holds a locking mechanism 320 in place, described in more detail below.

Handle 28 is fixed to one end of a hollow rotation tube 322 that extends through bushing 318. A flush wand 26 is attached to the other end of hollow rotation tube 322 with a screw 325, or other suitable fastener. Thus, pushing handle 28 downwardly causes flush wand 26 to rotate upwardly and pull open any valves connected to the flush wand.

As described earlier and shown in FIG. 1, flush wand 26 is connected to both the low-volume flush valve and the high-volume flush valve. Flush wand 26 is connected to the low-volume flush valve with a chain having little slack, and to the high-volume flush valve with a chain having a greater degree of slack. Thus, when handle 28 is pushed, the low-volume flush valve is opened after a first, lesser amount of wand rotation. The high-volume flush valve is opened only after flush wand 26 travels through a second, greater amount of rotation.

To prevent handle 28 from rotating fully and opening the high-volume flush valve during ordinary use, handle system 310 includes a locking system that prevents handle 28 from rotating far enough to open the high-volume flush valve unless button 34 is depressed while pushing on handle 28.

The locking system includes a wand rotation lock shaft 326. Wand rotation lock shaft 326 extends through the interior of wand rotation tube 322. Button 34 is attached to one end of wand rotation lock shaft 326, and a wand rotation stop bracket 328 is attached to the other end. When button 34 is not depressed, wand rotation stop bracket 328 extends over the end of wand rotation lock shaft 326 such that it fits snugly over the top of flush wand 26. The top surface 330 of flush wand 26 is flat, causing wand rotation stop bracket 328 to rotate when the flush wand is rotated. When button 34 is depressed, however, wand rotation stop bracket 328 is pushed away from top surface 330 of flush wand 26, and thus is not rotated with the wand. A spring 332 is disposed around wand rotation lock shaft 326 to bias wand rotation stop bracket 328 towards the locking position by pushing against the outside of the toilet tank.

The rotational travel path of flush wand 26 is limited by two appendages on locking mechanism 320. First, locking mechanism 320 has a wand rest support 334 that holds flush wand 26 in the rest position when handle 28 is not being operated. Second, locking mechanism 320 has a wand rotation stop 336. Wand rotation stop 336 is configured to be a barrier to the rotation of flush wand 26 past the point at which the low-volume flush valve is opened, unless button 34 is depressed. As described above and illustrated in FIGS. 10–11, when button 34 is not depressed, wand rotation stop bracket 328 turns with flush wand 26. Thus, wand rotation stop bracket 328 contacts wand rotation stop 336 after flush wand 26 has been rotated far enough to open the low-volume valve, and thus prevents the flush wand from being turned further. Wand rotation stop 336 may include an adjustment mechanism, typically a small screw 338, to allow the exact stop position of flush wand 26 to be fine-adjusted.

Figure 12:
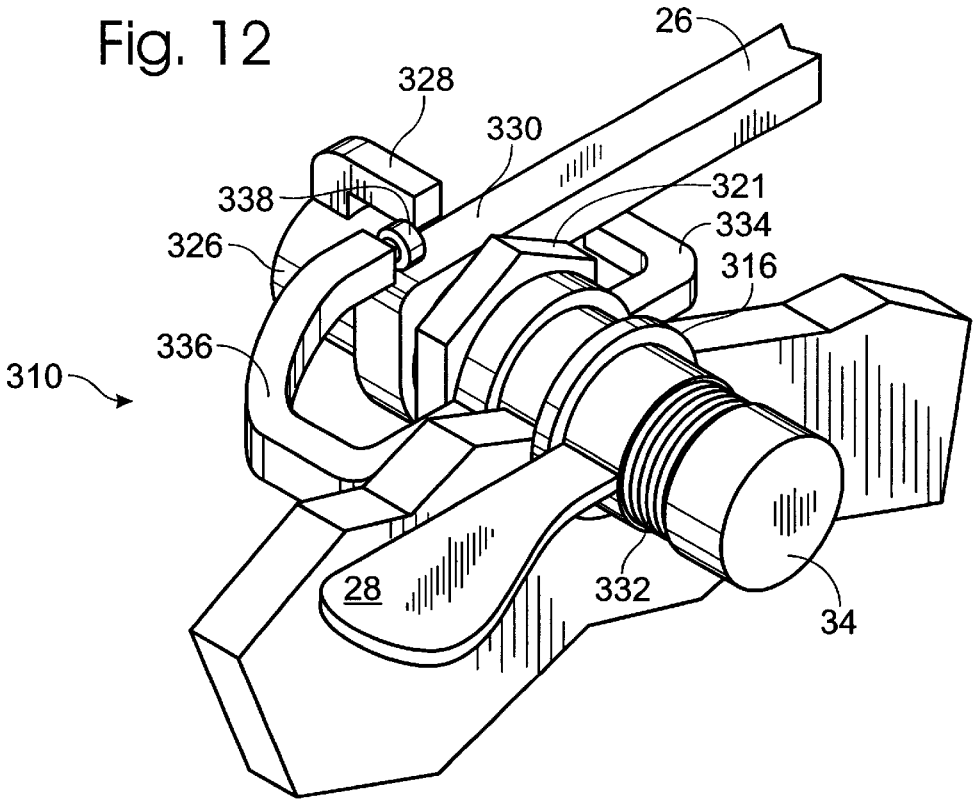
FIG. 12 is an isometric view of the toilet handle assembly of FIG. 9, illustrating the operation of the release button for a high-volume flush.
Figure 13:
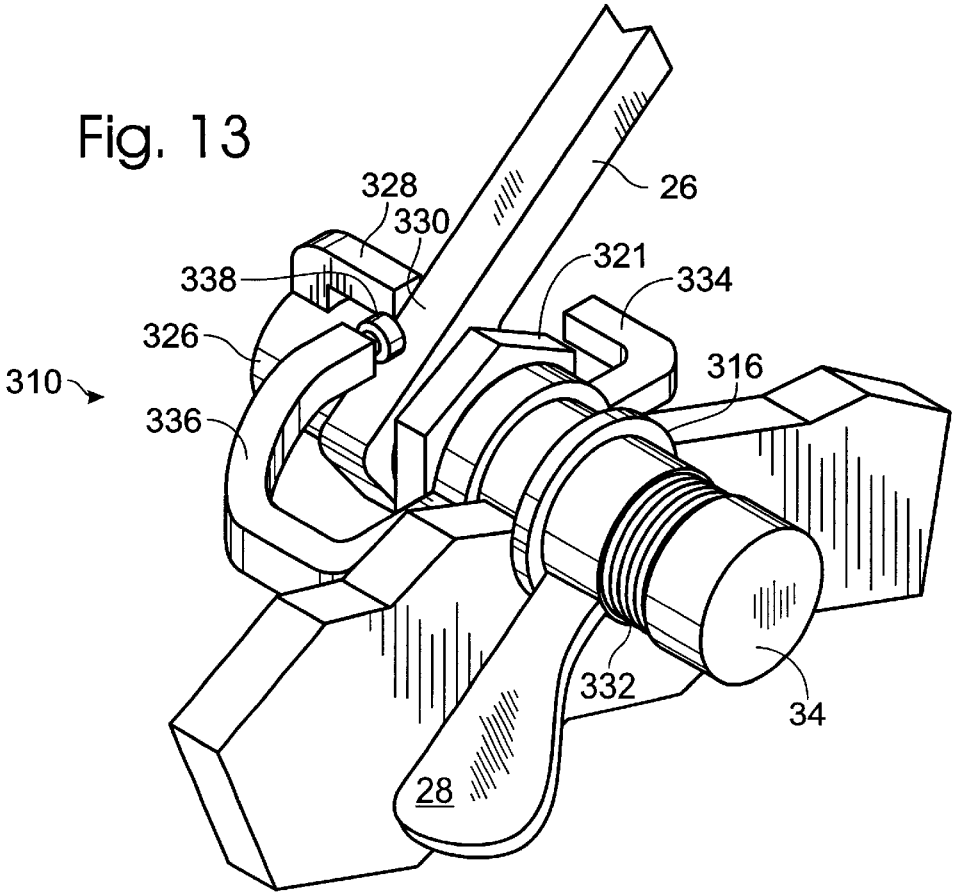
FIG. 13 is an isometric view of the toilet handle assembly of FIG. 9, illustrating the operation of the handle for a high-volume flush.

In contrast, when button 34 is depressed, wand rotation stop bracket 328 is disengaged from flush wand 26, and does not turn with the wand. It thus does not contact wand rotation stop 336 as the handle is pushed, and does not stop rotation of flush wand 26. This is shown in FIGS. 12–13. In this instance, flush wand 26 is free to turn far enough to open the high-volume flush valve and to thus allow the entire toilet tank to drain. Once the toilet tank has drained, flush wand 26 returns to its rest position against wand rest support 334, and wand rotation stop bracket 328 is snapped back into position over flush wand 26 by spring 332, readying the toilet for a low volume flush.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

I claim:

1. A dual flush volume outflow valve assembly for a toilet tank, comprising:

a base having an opening configured to pass water out of the toilet tank;

a lower outflow tube section extending upwardly from the base and having a hollow interior, wherein the lower outflow tube is separable from the base to pass a first, larger volume of water from the toilet tank to the toilet bowl when opened;

an upper outflow tube section slidably coupled to and extending upwardly from the lower outflow tube section, the upper outflow tube section having a hollow interior;

a cap piece extending upwardly from the upper outflow tube, wherein the cap piece is separable from the upper outflow tube to pass a second, smaller volume of water from the toilet tank to the toilet bowl; and an overflow tube slidably coupled to the cap piece, wherein the overlow tube is positioned over and in line with the opening.

2. The outflow valve assembly of claim 1, further comprising a locking collar disposed around one of the upper outflow tube section and the lower outflow tube section for fixing the upper outflow tube section in position relative to the lower outflow tube section.

3. The outflow valve assembly of claim 1, the upper outflow tube section having a position relative to the lower outflow tube section, wherein the position of the upper outflow tube section infinitely adjustable relative to the lower outflow tube section.

4. The outflow valve assembly of claim 1, wherein the overflow tube is formed from a lower overflow tube section slidably coupled to an upper overflow tube section.

5. The outflow valve assembly of claim 4, further comprising a locking collar to fix the upper overflow tube section in position relative to the lower overflow tube section.

6. The outflow valve assembly of claim 4, wherein the lower overflow tube section is integral with the cap piece.

7. A dual flush volume outflow valve assembly for a toilet tank, comprising:

a base configured to be attached to the toilet tank, the base including an opening for passing water out of the toilet tank and an upper surface;

a guide coupled to and extending upwardly from the base;

a lower outflow tube section resting on and extending upwardly from the base, the lower outflow tube section including a lower surface configured to rest against the upper surface of the base to form a high-volume flush valve such that separating the lower surface of the lower outflow tube section from the upper surface of the base passes a first, greater volume of water from the toilet tank;

an upper outflow tube section adjustably coupled to and extending upwardly from the lower outflow tube section, the upper outflow tube section including a top surface;

a cap piece resting on and extending upwardly from the top surface of the upper outflow tube section, the cap piece including a lower surface configured to rest against the top surface of the upper outflow tube section to form a low-volume flush valve such that separating the lower surface of the cap piece from the top surface of the upper outflow tube section passes a second, lesser volume of water from the toilet tank, wherein the position of the low-volume flush valve relative to the high-volume flush valve is variable by adjusting the upper outflow tube section relative to the lower outflow tube section; and an overflow tube slidably coupled with the cap piece such that the position of the overflow tube relative to the cap piece is slidably adjustable.

8. The outflow valve assembly of claim 7, wherein the upper outflow tube section is slidably coupled to the lower outflow tube section.

9. The outflow valve assembly of claim 8, further comprising a locking collar disposed around one of the upper outflow tube section and the lower outflow tube section for fixing the upper outflow tube section in position relative to the lower outflow tube section.

10. The outflow valve assembly of claim 7, the upper outflow tube section having a position relative to the lower outflow tube section, wherein the position of the upper outflow tube section is selectable from a continuous range of possible positions.

11. The outflow valve assembly of claim 7, further comprising an overflow tube in fluid communication with the upper outflow tube section, wherein the overflow tube has an adjustable length.

12. The outflow valve assembly of claim 11, wherein the overflow tube is formed from a lower overflow tube section slidingly coupled to an upper overflow tube section.

13. The outflow valve assembly of claim 12, further comprising a locking collar to fix the upper overflow tube section in position relative to the lower overflow tube section.

* * * * *